United States Patent [19]

Gordon et al.

[11] 4,320,841

[45] Mar. 23, 1982

[54] DETECTION AND SORTING SYSTEMS

[75] Inventors: Hilton P. Gordon, Johannesburg, South Africa; Arthur W. Richards, Plenty, Australia; Albert P. Hawkins, Caulfield, Australia; Alan Boyle, Warrandyte, Australia

[73] Assignee: Sphere Investments Limited, Nassau, The Bahamas

[21] Appl. No.: 951,952

[22] Filed: Oct. 16, 1978

[30] Foreign Application Priority Data

Jun. 5, 1978 [ZA] South Africa ..... 78/3198

[51] Int. Cl.[3] ..... B07C 9/00

[52] U.S. Cl. ..... 209/552; 209/586; 209/589; 250/255

[58] Field of Search ..... 209/552, 576, 577, 586, 209/589; 250/253, 255, 394, 395

[56] References Cited

U.S. PATENT DOCUMENTS 2,717,693 9/1955 Holmes ..... 250/255 X 3,052,353 9/1962 Pritchett ..... 209/576 X 3,097,744 7/1963 Hutter et al. ..... 209/577 X

*Primary Examiner*—Joseph J. Rolla

*Attorney, Agent, or Firm*—Cushman, Darby & Cushman

[57] ABSTRACT

Method and apparatus for sorting objects according to the degree to which they possess a required characteristic. Objects are moved in a line on a conveyor belt past a line of detectors each responsive to the required characteristic. Each detector produces a time sequence of output signals and the signals from successive detectors are accumulated. The objects are projected from the downstream end of the conveyor belt in a free flight path past an optical scanner and a series of air blast nozzles. The scanner determines the portions and sizes of the objects and objects selected on a comparison of the detector signals and signals from the scanner are blasted with air jets from appropriate nozzles so as to be deflected from their free flight trajectory. Deflected and undeflected objects are caught in separate collection bins.

20 Claims, 7 Drawing Figures

DETECTION AND SORTING SYSTEMS

BACKGROUND OF THE INVENTION

This invention relates generally to detection and sorting systems. More particularly, the invention is concerned with systems which require detection of a characteristic in a moving object or series of objects.

In a sorting system use is generally made of a detector which is responsive to a selected characteristic and to which each object which is to be sorted is exposed. A decision is made on the suitability of an object by examining the detector output and the object is then accepted or rejected. This approach while being simple suffers from the disadvantage that statistically it is not always accurate. For example the orientation of an object may be such that the presence of a desirable feature is over emphasized or minimized and a wrong decision on the object may therefore be made. Similarly if objects are being sorted on the basis of their radioactivity, radioactive counts obtained from the objects are subject to statistical variations and consequently the classification of an object after exposure to a single detector may be faulty.

The present invention provides a method and means for detecting a characteristic in a moving object or series of objects with improved accuracy and a correspondingly improved method and apparatus for sorting objects according to the degree to which they possess a certain characteristics.

SUMMARY OF THE INVENTION

The invention provides a method of detecting a characteristic in an object comprising moving the object past a plurality of detectors each responsive to said characteristic to generate a signal which is dependent on the degree to which the object possesses said characteristic and deriving a detection signal which is dependent on the output signals of the detectors.

More particularly, the invention provides a method of detecting a characteristic in a plurality of objects comprising:

passing the objects in a line at controlled speed along a path which causes them successively to pass a plurality of detectors spaced apart along said path and each responsive to said characteristic whereby to derive from each detector a time sequence of output signals dependent on the degree to which successive objects possess said characteristic;

scanning the objects as they move along said path so as to derive a time sequence of scanning signals indicative of the positions occupied by the objects throughout their movement along said path; and deriving accumulation signals each dependent on an accumulation of a signal derived from the last detector in the direction of movement at a time indicated by the scanning signal to be a time of passage of an object past that last detector and the signal derived from each preceding detector at a time indicated by the scanning signals to be a time of passage of the same object past that preceding detector.

The invention also provides a method of sorting objects according to the degree to which they possess a certain characteristic comprising:

passing the objects in a line at controlled speed along a path which causes them successively to pass a plurality of detectors spaced apart along said path and each responsive to said characteristic whereby to derive from each detector a time sequence of output signals dependent on the degree to which successive objects possess said characteristic;

scanning the objects as they move along said path so as to derive a time sequence of scanning signals indicative of the positions occupied by the objects throughout their movement along said path;

deriving control signals each dependent on an accumulation of a signal derived from the last detector in the direction of movement at a time indicated by the scanning signal to be a time of passage of an object past that last detector and the signal derived from each preceding detector at a time indicated by the scanning signals to be a time of passage of the same object past that preceding detector; and using said control signals to control sorting of the objects as they move from said path.

The scanning of the objects may take place before or after the objects have passed said detectors.

Preferably, the objects are moved past the detectors at uniform speed.

Preferably too, the signals derived from all detectors are continuously accumulated such that each signal derived from said last detector is accumulated with the signal derived from each preceding detector at a time equal to D/V before the derivation of said signal from the last detector, where D is the distance between said last detector and said preceding detector and V is said uniform speed of movement of the objects, and said scanning signals are used to cause gating of the continuously accumulated signals to derive said control signals.

The invention also provides apparatus for detecting a characteristic in an object comprising means to move the object along a path, a plurality of detectors spaced apart along said path and each responsive to said characteristic to generate a signal which is dependent on said characteristic, and means to generate a detection signal which is dependent on the output signals of the detectors.

More particularly, the invention provides apparatus for detecting a characteristic in a plurality of objects comprising:

means to move objects to be sorted in a line at controlled speed along a path;

a plurality of detectors spaced apart along said path and each responsive to said characteristic whereby, in use of the apparatus, each detector provides a time sequence of output signals dependent on the degree to which successive objects possess said characteristic;

scanning means to scan the objects as they move along said path so as to derive a time sequence of scanning signals indicative of the positions occupied by the objects throughout their movement along said path; and signal processing means to derive output signals each dependent on an accumulation of a signal derived from the last detector in the direction of movement at a time indicated by the scanning signals to be a time of passage of an object past that last detector and the signal derived from each preceding detector at a time indicated by the scanning signals to be a time of passage of the same object past that preceding detector.

The invention also provides apparatus for sorting objects according to the degree to which they possess a certain characteristic comprising:

means to move objects to be sorted in a line at controlled speed along a path;

a plurality of detectors spaced apart along said path and each responsive to said characteristic whereby, in use of the apparatus, each detector provides a time sequence of output signals dependent on the degree to which successive objects possess said characteristic;

scanning means to scan the objects as they move along said path so as to derive a time sequence of scanning signals indicative of the positions occupied by the objects throughout their movement along said path;

signal processing means to derive control signals each dependent on an accumulation of a signal derived from the last detector in the direction of movement at a time indicated by the scanning signals to be a time of passage of an object past that last detector and the signal derived from each preceding detector at a time indicated by the scanning signals to be a time of passage of the same object past that preceding detector; and object sorting means to sort the objects as they move from said path in accordance with said control signals.

The means to move the objects in said path may be operative to move the objects past the detectors at uniform speed. More particularly, such means may comprise a conveyor belt having a run extending along said path and the detectors may be positioned adjacent that conveyor belt run.

The conveyor belt may be operative to project said objects in free flight from the end of said run and said path may include part of the free flight path of the objects. In this case the scanning means may be operative to scan the objects while in the free flight segment of said path.

Preferably, said signal processing means comprises means continuously to accumulate signals derived from all detectors such that each signal derived from said last detector is accumulated with the signal derived from each preceding detector at a time equal to D/V before the derivation of said signal of the last detector, where D is the distance between said last detector and said preceding detector and V is said uniform speed of movement of the objects, and means responsive to said scanning signals to gate the continuously added signals to derive said control signals.

Each detector may comprise a plurality of sensors responsive to said characteristic and these sensors may be spaced transversely of said path of movement of the objects.

BRIEF DESCRIPTION OF THE DRAWINGS

In order that the invention may be more fully explained one particular ore sorting apparatus and various detection systems which may be incorporated in that apparatus in accordance with the present invention will be described with reference to the accompanying drawings in which.

DESCRIPTION OF PREFERRED EMBODIMENT

Figure 1:
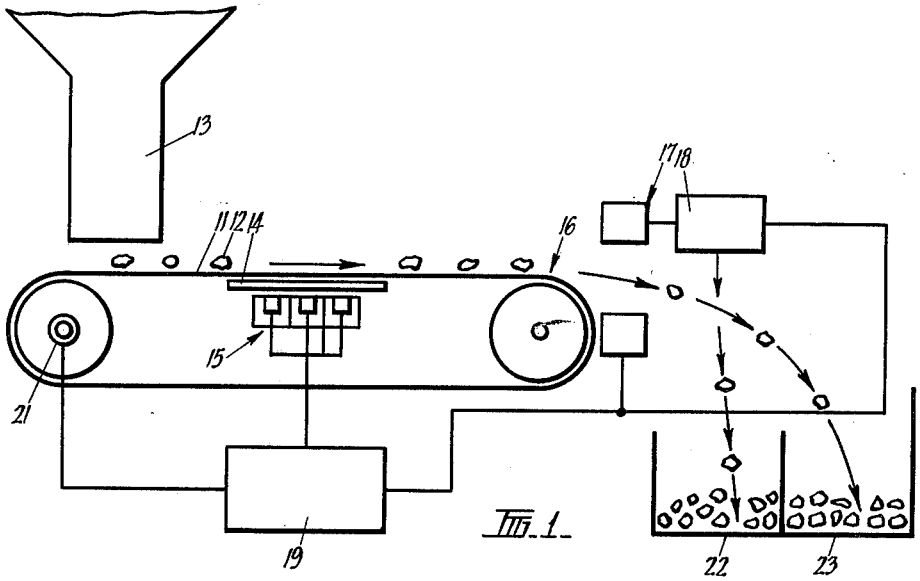
FIG. 1 is a schematic side view of the ore sorting apparatus.

The ore sorting apparatus illustrated in FIG. 1 comprises a belt conveyor 10 having an upper run 11 onto which the objects 12 to be sorted are fed from a hopper 13. The objects 12 are carried by the upper run of the conveyor over a steel plate bed 14 which is positioned over detecting means 15.

The objects 12 are projected from the forward end 16 of the belt conveyor so as to pass in free flight through the field of an optical scanner 17 and past the deflector means 18. The deflector means may comprise a series of air blast nozzles to which compressed air is delivered via air valves controlled by signals from a signal analyzer 19. Signal analyzer 19 receives inputs from the detecting means 15, the optical scanner 17 and a belt speed tachometer 21 and produces output signals which control the air valves of deflector means 18 such that objects possessing the selected characteristics to the required degree are blasted with air jets so as to be deflected into a collecting bin 22 whereas rejected objects continue in free flight into a reject bin 23.

The illustrated apparatus may be used for sorting rocks of radioactive ore in which case the detecting means 15 comprises a number of scintillation sensors 24 which are arranged to monitor imaginary channels on the belt run 11.

Figure 2:
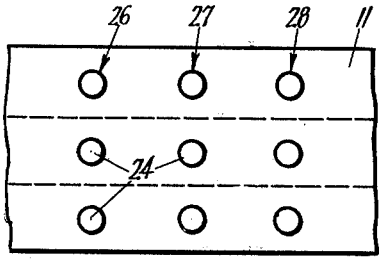
FIGS. 2 and 3 are plan views of alternative arrangements in detectors incorporated in the apparatus.
Figure 3:
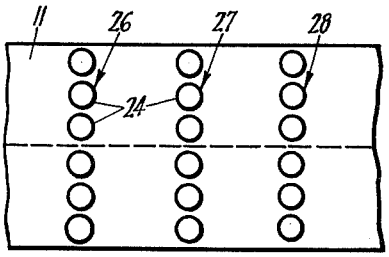

The arrangement of the scintillation sensors depends on the size and radioactive properties of the rocks to be sorted. Thus where the rocks discharged from hopper 13 are generally small, this being ensured by a grading operation, the scintillation sensors may be arranged in the manner indicated in FIG. 2 so as to divide the belt run 11 into a number of narrow channels 25 such that each scintillation sensor 24 is able effectively to monitor the width of a channel. In this case there is associated with each channel a series of scintillation detectors spaced at equal intervals along the channel, each detector being constituted by a single scintillation sensor 24. In the drawings there are three such detectors for each channel indicated as 26, 27 and 28 respectively, although it will be appreciated from the ensuing description that this number may be varied.

Where the rocks to be sorted are of larger size such that they cannot be scanned effectively by a single scintillation sensor the scintillation sensors 24 may be arranged in groups extending transversely across appropriately wider channels so that each detector is constituted by such a group of sensors. This arrangement is illustrated in FIG. 3 which shows (for each channel) three detectors 26, 27, 28 each constituted by a group of three scintillation sensors 24.

The detectors are set between heavy lead partitions extending along the belt between the channels to provide protection against cross-channel interference.

The ensuing description explains the manner in which analyzer 19 processes signals derived from the detectors in a single belt channel but it will be appreciated that the analyzer must have multiple processing circuits to carry out the same operations for each channel.

Analyzer 19 operates to obtain signals from all detectors 26, 27, 28 at regular time intervals determined by the speed of the belt so that each signal is representative of the output of the respective detector when a particular short segment of the belt is passing that detector, regardless of whether or not that particular segment is occupied by an ore rock. The analyzer accumulates these signals in such a way that each signal from the last detector 28 is accumulated with the signal from each preceding detector at a time equal to D/V before the derivation of the signal from the last detector, where D is the distance between the last detector and the preceding detector and V is the speed of movement of the belt. This accumulation proceeds continuously to produce signals which are each representative of the outputs of all detectors obtained from a particular belt segment.

The signals derived from the scanning means indicate which particular belt segments were occupied by ore rocks to be sorted and the analyzer uses these signals to compare the scanning signals with the accumulation signals appropriate to those belt segments to produce control signals used to control sorting. The comparison effectively gates the accumulation signals so that the final control signals are each dependent on an accumulation of a signal derived from the last detector at a time indicated by the scanning signal to be a time of passage of an object past the last detector and the signal derived from each preceding detector at a time indicated by the scanning signals to be a time of passage of the same object past the preceding detector.

Figure 4:
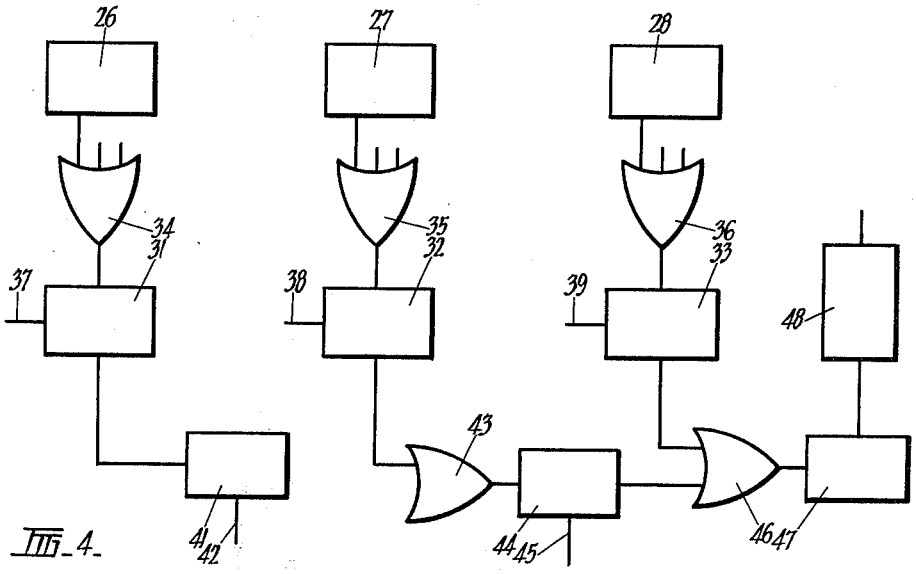
FIGS. 4, 5 and 6 are circuit diagrams of alternative signal processing arrangements for deriving accumulation signals.

One particular circuit for carrying out the above functions of the analyzer 19 is illustrated in FIG. 4. This circuit comprises a series of edge triggered flip-flops 31, 32, 33 to receive scintillation counts from the detectors 26, 27, 28. In the case where each scintillation detector is constituted by a group of sensors as shown in FIG. 3 the outputs of the individual sensors are fed to OR gates 34, 35, 36 to provide the inputs to the flip-flops but in the case where the scintillation sensors are arranged in the manner of FIG. 2 these OR gates can be dispensed with.

Flip-flops 31, 32, 33 have clock reset inputs 37, 38, 39. Clock pulses are applied to these inputs at a frequency proportional to the speed of the belt as measured by tachometer 21. The constant of proportionality is chosen so that the time interval between successive pulses represents a very short distance of travel of the belt. During this time interval the flip-flops are set by any scintillation counts produced by the detectors so that at the end of this same time interval the signal fed to and clocked into the shift registers 41, 44, 47 is indicative of whether a count has been received from the scintillation detectors 26, 27, 28 respectively. The flip-flops are reset at the beginning of each clock period in readiness for the next time interval.

The output signals from flip-flop 31 are fed to a shift register 41 and are clocked through that shift register at a rate controlled by a clock input 42. These signals are thus stored for a delay time governed by clock input 42 and are then fed to an OR gate 43 which also receives the output signals from flip-flop 32. The output signals from flip-flop 32 are thus accumulated with the delayed output signals from flip-flop 31 and the accumulated counts are fed to a further shift register 44.

The clock rate of the clock input 42 to shift register 41 is chosen relative to the number of bit stores in the shift register and the belt speed such that each delayed count arriving at OR gate 43 from shift register 41 is associated with the same belt segment as the count arriving from shift register 33.

The accumulated counts progress through shift register 44 at a rate governed by a clock input 45 and are passed to an OR gate which also receives counts from flip-flop 33. The clock rate of input 45 is chosen so that the accumulated signals arriving at OR gate 46 from shift register 44 are associated with the same belt segments as the signals arriving from flip-flop 33. The output of OR gate 43 is connected to a further shift register 47 which effectively adds the count from flip-flop 33 and the accumulated counts from shift register 44.

The accumulated counts obtained by shift register 47 are transferred to a large shift register 48 which runs at a relatively high clock frequency. The counts so accumulated will include counts derived from objects which passed over the detectors and are held in shift register 48 until these rocks have been scanned by the optical scanner 17.

Figure 7:
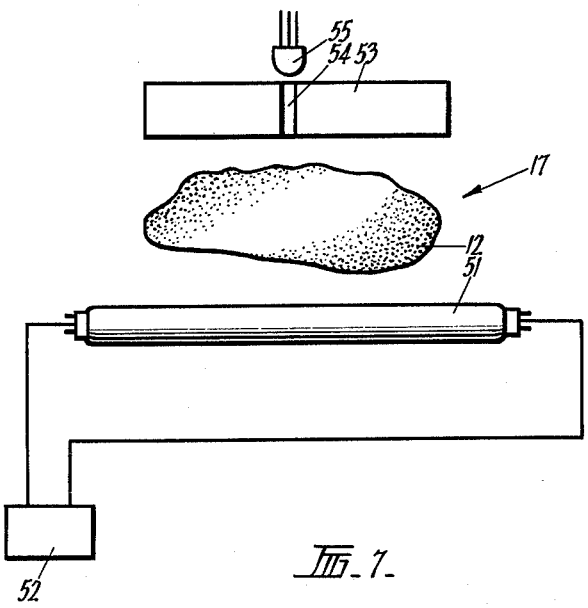
FIG. 7 is an enlarged view of optical scanning equipment incorporated in the apparatus.

As illustrated in FIG. 7, optical scanner 17 comprises a fluorescent tube 51 which is a high output reflecting type and which is mounted below the rock stream. It is powered by an inverter 52 at a relatively high frequency and is chosen so that its phosphor persistance is long enough to eliminate practically all high frequency light modulation due to the inverter. A collimator plate 53 is mounted above the rock stream. This collimator plate consists of a large slab of suitable material through which a plurality of collimator holes 54 are bored. A phototransistor 55 is mounted above each hole.

The collimator holes and transistors are arranged in a single line extending transversely of the path of movement of the rocks. When no rock is between the tube 51 and the collimator plate 53 fluorescent light is incident on all of the transistors which therefore conduct. However, when a rock passes between the tube and the collimator plate the light to a number of the collimator holes is interrupted by the rock and the current of each phototransistor associated with these holes falls to its dark value. The number of phototransistors which are turned off is dependent on the area of the particle projected onto collimator plate 53 and a count of the transistors which are off gives an indication of the projected area of the rock.

The optical scanner 17 is also controlled by clock pulses related to the speed of travel of the belt. At intervals controlled by the clock rate the outputs of the line of phototransistors are applied to a parallel-to-serial shift register from which they pass to the analyzer 19 as a series of pulses indicative of a segmental area of rock tranversing the optical scanner in a particular time interval and also the position of that segmental area transversely of the channel i.e. the degree to which that segmental area is "off centre". These signals are passed to the analyzer 19 where they are processed, in a manner to be described, to modify the area measurement according to the degree to which the rock is "off centre" in the channel and the processed signals are applied to a comparator which compares them with signals (also processed) from the shift register 48 which correspond to the segment of the belt occupied by that particular rock segment during passage over the detectors. The comparator provides a measure of radioactivity of the rock on a per unit area basis and produces output signals according to whether that intensity exceeds a selected value. These signals are used to control transmission of signals to the air blast valves so that selected rocks are blasted and diverted into bin 22 and unwanted rocks are allowed to travel unimpeded into bin 23. The comparator thus effectively gates the signals from shift register 48 so that only those signals corresponding to the presence of a rock are used to derive control signals.

The need to process the signals from the optical scanner arises because the sensitivity of the detectors to radiation eminating from particular regions of a rock will vary according to the degree to which that region is displaced from the centre of the channel. When each detector comprises a number of sensors spaced across the channel, the senitivity of detection becomes more uniform across the width of the channel but nevertheless is decreased in the regions between adjacent sensors and in the end regions. A sensitivity variation curve can be determined empirically for the detectors and the pulses from the optical scanner are passed through a compensating circuit in which each pulse is multiplied by a factor according to the position of the particular phototransistor from which that pulse was derived. The multiplication factors can be preset to compensate for the variations in sensitivity of the detectors across the channel. Thus scanning pulses corresponding to a channel region of decreased detector sensitivity would be multiplied by a factor larger than the factor applied to pulses corresponding to a region of high sensitivity. The area counts are thus effectively normalized or standardized and are passed to an accumulator from which they are applied to the comparator.

The signals from shift register 48 are also processed before application to the comparator. More particularly, the signals are passed through a multiplier (burst generator) and a divider to an accumulator which applies the processed signals to the comparator. The divider can be adjusted to suit the grade or ore being tested and to determine the radioactivity intensity required to produce rock acceptance signals.

The signals transmitted to the air blast valves are those derived from the optical scanner which are indicative of both the area and the position of a particular rock segment i.e. the signals before detector sensitivity compensation. The control signals dictate which of these scanning signals are to be transmitted to the air blast valves and the selected signals are clocked through a shift register so that they operate the valves after an appropriate time delay and according to the precise position of the rock in the channel.

The various clock pulses to control the transfer of signals through the flip-flops and shift registers may be obtained by signal synthesizers of the type disclosed in our copending patent application entitled "Signal Synthesizer", now South African Pat. No. 78/3421.

The circuit of FIG. 4 is generally satisfactory for producing accept/reject control signals in a sorting operation. However, if the rocks to be sorted include some rocks of intense radioactivity the various shift registers can become saturated and some counts will be lost. In this regard it is to be understood that the term "accumulation" as used herein is not limited to a total addition of all accumulated signals. The likelihood of shift register saturation increases as more information is accumulated through the OR gates. The saturation limit of the shift registers is not significant in a simple sorting operation but in some operations it is important to monitor the grade of ore going through the machine. In such cases the circuit of FIG. 5 will be appropriate.

Figure 5:
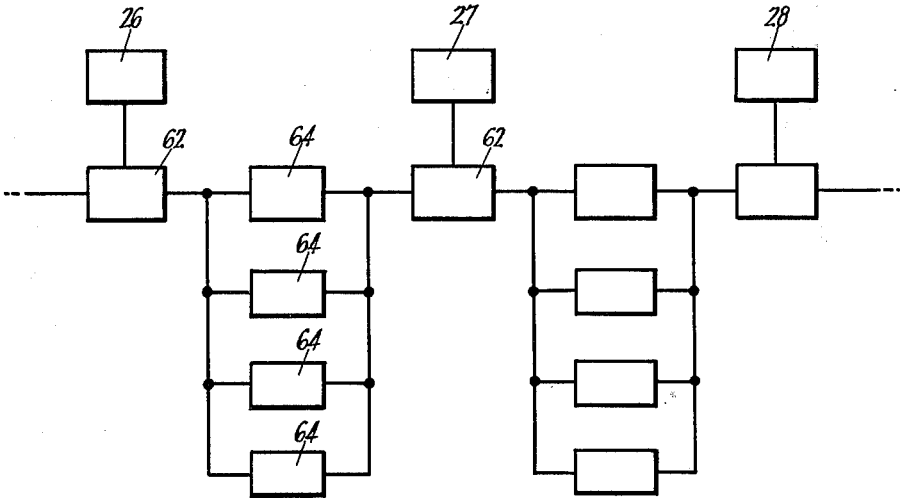

The circuit of FIG. 5 is a direct replacement for the delay circuit of FIG. 4 and is designed to record accurately the counts of the various scintillation detectors in each channel. The output of each scintillation detector is counted in a parallel load binary counter 62 for a period Tc. Tc is the clocking period of the shift registers 64. At the end of each period Tc, the binary information in the counter 62 is loaded in parallel into a number of shift registers 64 and the binary counter is reset by loading in parallel the binary count held by the preceding group of shift registers 64 into the counter. The binary counter is then ready to record the counts from the scintillation detector 32 during the next period Tc. Consequently the scintillation count associated with a particular section of ore particle is accurately accumulated by way of direct addition. The accumulated count passes from binary counter to binary counter as the associated ore particle is moved on the belt 11 and eventually is fed into a shift register which functions in the same way as the shift register 48 of FIG. 4.

Figure 6:
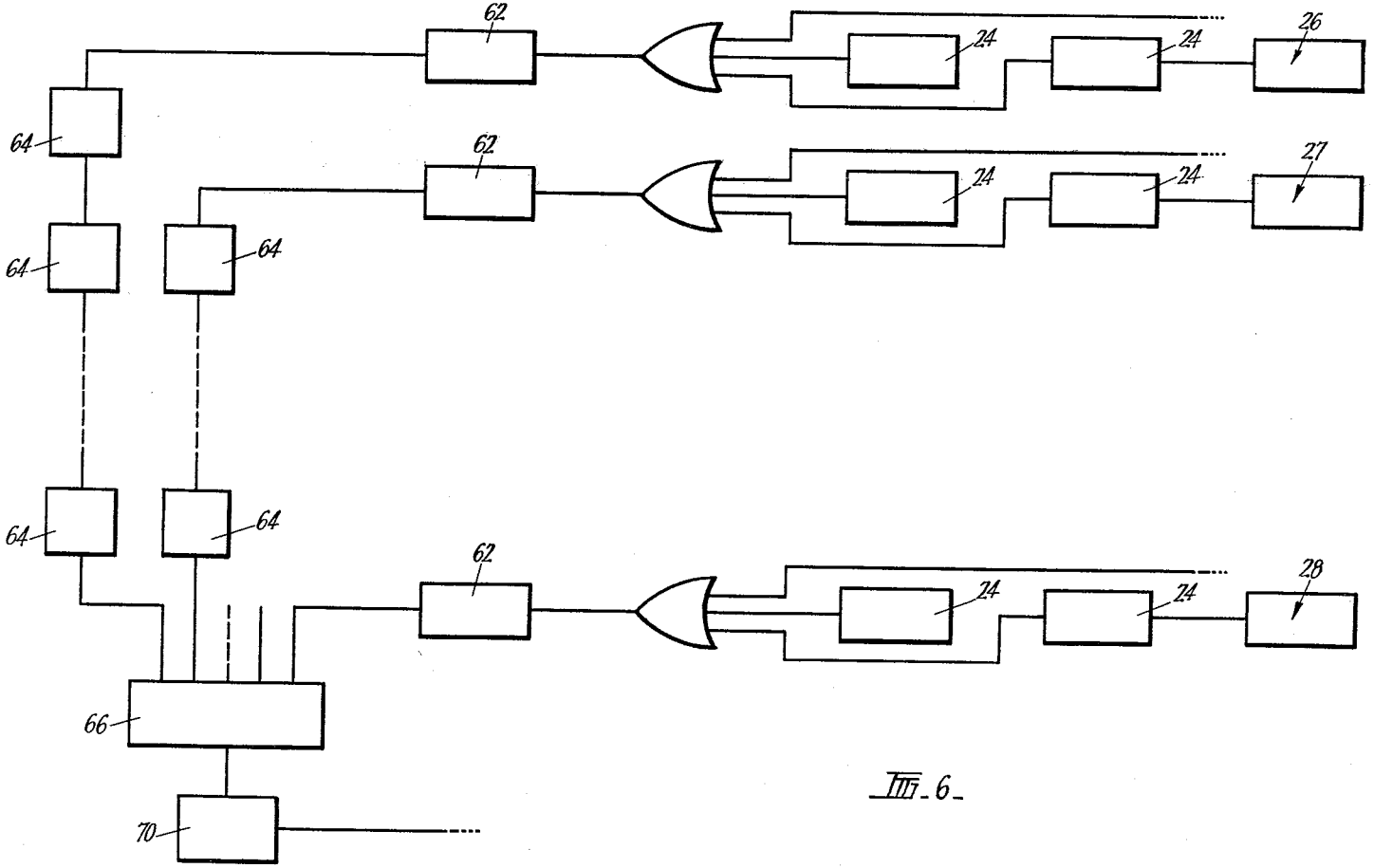

An alternative embodiment is that shown in FIG. 6. In this circuit, the counts accumulated in counters 62 from the scintillation detectors during each shift register 64 clock period Tc are loaded into a shift register chain 64. The number of shift register blocks 64 in each chain is chosen so that the information collected during a period Tc corresponding to a given position of a particle in relation to the respective scintillation detector arrives at the binary adder 66 input at the same time as the counts collected from the last scintillation detector counter when the particle is in the same position in relation to the last scintillation detector. The counters 62 are reset at the beginning of each period Tc and the binary number representing the sum of the counts collected during the period Tc is read into the shift registers 64 at the end of each period. The binary adder 66 sums the binary numbers frome each of the shift register chains corresponding to each scintillation detector counter and the sum, in the form of a binary number is then fed to a shift register 70 which delays the information for a period corresponding to the time taken for the rock to traverse the distance between the last scintillation detector and the optical scanner.

The illustrated apparatus has been advanced by way of example and could be modified considerably. For example, the detectors need not be scintillation detectors and it would be possible to use other types of detectors for detecting other characteristics of objects to be sorted. Although it is preferred to scan the rocks while in free flight since this allows a transmission scanner to be used, the rocks could be scanned with a reflective or other suitable scanner while still on the belt. In that case, the rocks could be scanned before arriving at the detectors and the detectors could then be operated to derive signals only when rocks were passing them. Moreover, the invention is not necessarily limited to sorting machines and a detection system in accordance with the invention could be used to provide an automatic grading or assay of a series of objects. It is accordingly to be understood that the invention is in no way limited to the details of the illustrated apparatus and that many modifications and variations will fall within its spirit and scope which extends to every novel feature and combination of features herein disclosed.

We claim:

1. A method of sorting objects according to the degree to which they possess a certain characteristic comprising:

passing the objects in a line at known speed along a path which causes them successively to pass a plurality of detectors spaced apart along said path and each responsive to said characteristic whereby to derive from each detector a time sequence of output signals dependent on the degree to which successive objects possess said characteristic;

scanning the objects as they move along said path so as to derive a time sequence of scanning signals which, based on said known speed of the objects, are indicative of the positions occupied by the objects throughout their movement along said path;

deriving control signals each dependent on an accumulation of a signal dervied from the last detector in the direction of movement at a time indicated by the scanning signal to be a time of passage of an object past that last detector and the signal derived from each preceding detector at a time indicated by the scanning signals to be a time of passage of the same object past that preceding detector, the signals derived from all detectors being continuously accumulated such that each signal derived from said last detector is accumulated with the signal derived from each preceding detector at a time equal to D/V before the derivation of said signal from the last detector, where D is the distance between said last detector and said preceding detector and V is said uniform speed of movement of the objects, and said scanning signals being used to cause gating of the continuously accumulated signals to derive said control signals; and using said control signals to control sorting of the objects as they move from said path.

2. A method as claimed in claim 1, wherein the scanning of the objects takes place after the objects have passed the detectors.

3. A method as claimed in claim 1, wherein the objects are moved past the detectors at uniform speed.

4. A method as claimed in claim 1, wherein the scanning signals are indicative of a size measurement of said objects and are compared with said accumulation signals in such a way that said control signals are dependent on the degree to which the objects possess said characteristic on a per unit of size basis.

5. A method as claimed in claim 4, wherein the scanning signals are also indicative of the positions occupied by the objects transversely of their direction of movement along said path and are modified according to those positions before comparison with the accumulation signals in order to compensate for variations in detector sensitivity across the path.

6. Apparatus for sorting objects according to the degree to which they possess a certain characteristic comprising:

means to move objects to be sorted in a line at known speed along a path;

a plurality of detectors spaced apart along said path and each responsive to said characteristic whereby, in use of the apparatus, each detector provides a time sequence of output signals dependent on the degree to which successive objects possess said characteristic;

scanning means to scan the objects as they move along said path so as to derive a time sequence of scanning signals which, based on said known speed, are indicative of the positions occupied by the objects throughout their movement along said path;

signal processing means to derive control signals each dependent on an accumulation of a signal derived from the last detector in the direction of movement at a time indicated by the scanning signals to be a time of passage of an object past that last detector and the signal derived from each preceding detector at a time indicated by the scanning signals to be a time of passage of the same object past that preceding detector, said signal processing means comprising means continuously to accumulate signals derived from all detectors such that each signal derived from said last detector is accumulated with the signal derived from each preceding detector at a time equal to D/V before the derivation of said signal of the last detector, where D is the distance between said last detector and said preceding detector and V is said uniform speed of movement of the objects, and means responsive to said scanning signals to gate the continuously added signals to derive said control signals; and object sorting means to sort the objects as they move from said path in accordance with said control signals.

7. Apparatus as claimed in claim 6, wherein the means continuously to accumulate signals comprises a series of shift registers and means to clock signals through those registers at a time rate dependent on said uniform speed of movement whereby to provide signal storage for time intervals necessary for said accumulation.

8. Apparatus as claimed in claim 6 wherein each detector comprises a plurality of sensors spaced transversely of said path of movement of the objects.

9. Apparatus as claimed in claim 6 wherein the means to move the objects in their path comprises a conveyor belt having a run extending along said path and operative to project said objects in free flight from the end of said run, said path includes part of the free flight path of those objects and the scanning means is operative to scan the objects while in the free flight segment of said path.

10. Apparatus as claimed in claim 6, wherein the means to move the objects in said path is operative to move the objects past the detectors at uniform speed.

11. Apparatus as claimed in claim 10, wherein the means to move the objects in said path comprises a conveyor belt having a run extending along said path and wherein the detectors are positioned adjacent that conveyor belt run.

12. Apparatus as claimed in claim 11, wherein the conveyor belt is operative to project said objects in free flight from the end of said run, said path includes part of the free flight path of the objects and the scanning means is operative to scan the objects while in the free flight segment of said path.

13. Apparatus as claimed in claim 6, wherein the scanning means is such that said signals are indicative of a size measurement of said objects and the signal processing means includes signal comparator means responsive to said accumulation signals and said scanning signals to derive said control signals in dependence on the degree to which the objects possess said characteristic on a per unit of size basis.

14. Apparatus as claimed in claim 13, wherein the scanning means is such that the scanning signals are also indicative of the positions occupied by the objects transversely of their direction of movement along said path and the signal processing means further comprises scanning signal processing means operative to process the scanning signals passing to the comparator means according to those positions whereby to compensate for variations in detector sensitivity across the path.

15. A method of sorting objects according to the degree to which they possess a certain physical characteristic comprising:

passing the objects in randomly spaced apart relationship in a line at a known speed along a path which causes them successively to pass a plurality of detectors spaced apart along said path and each responsive to said characteristic whereby to derive from each detector a time sequence of output signals dependent on the degree to which successive objects possess said characteristic;

scanning the objects as they move along said path so as to derive a time sequence of scanning signals which, based on said known speed of the objects, are indicative of the positions occupied by the objects throughout their movement along said path;

accumulating the detector signals derived from the detectors and, based on said known speed of the objects, using the scanning signals as an accurate measure of the time of passage of each of the objects past each of the detectors so as to derive control signals each dependent on an accumulation of a signal derived from the last detector in the direction of movement at a time indicated by the scanning signals to be a time of passage of an object past that last detector and the signal derived from each preceding detector at a time indicated by the scanning signals to be a time of passage of the same object past that preceding detector; and using said control signals to control sorting of the objects as they move from said path.

16. A method as claimed in claim 15 wherein the scanning of the objects takes place after the objects have passed the detectors.

17. Apparatus for sorting objects according to the degree to which they possess a certain characteristic comprising:

means to move objects to be sorted in randomly spaced apart relationship in a line and at a known speed along a path;

a plurality of detectors spaced apart along said path and each responsive to said characteristic whereby, in use of the apparatus, each detector provides a time sequence of output signals dependent on the degree to which successive objects possess said characteristic;

scanning means to scan the objects as they move along said path so as to derive a time sequence of scanning signals which, based on said known speed of the objects, are indicative of the positions occupied by the objects throughout their movement along said path;

signal processing means operative to store said scanning signals, to accumulate the detector signals derived from the detectors and, based on said known speed of the objects, to make use of the stored scanning signals as a measure of the times of passage of each of the objects past the successive detectors whereby to derive control signals each dependent on an accumulation of a signal derived from the last detector in the direction of movement at a time indicated by the scanning signal to be a time of passage of an object past that last detector and the signal derived from each preceding detector at a time indicated by the scanning signals to be a time of passage of the same object past that preceding detector, and object sorting means to sort the objects as they move from said path in accordance with said control signals.

18. Apparatus as claimed in claim 17 wherein the means to move the objects in said path comprises a conveyor belt having a run extending along said path, said detectors are positioned adjacent the conveyor belt run, the conveyor belt is operative to project said objects in free flight from the end of said line, said path includes part of the free flight path of the objects, and the scanning means is operative to scan the objects while in the free flight segment of said path.

19. Apparatus as claimed in claim 17 wherein the scanning means is such that said signals are indicative of a size measurement of said objects as well as of the positions of those objects and the signal processing means includes signal comparator means responsive to the accumulated detector signals to derive said control signals in dependence on the degree to which the objects possess said characteristic on a per unit of size basis.

20. Apparatus as claimed in claim 19, wherein the scanning means is such that the scanning signals are also indicative of the positions occupied by the objects transversely of their direction of movement along said path and the signal processing means further comprises scanning signal processing means operative to process the scanning signals passing to the comparator means according to those positions whereby to compensate for variations in detector sensitivity across the path.

* * * * *